US007009616B2

(12) United States Patent
Mendelson et al.

(10) Patent No.: US 7,009,616 B2
(45) Date of Patent: Mar. 7, 2006

(54) MULTI-MODE DISPLAY

(75) Inventors: Jonathan D. Mendelson, Mountain View, CA (US); Oscar I. Medina, San Jose, CA (US); Susan R. Poniatowski, San Jose, CA (US)

(73) Assignee: Silicon Graphics, Inc., Mountain View, CA (US)

( * ) Notice: Subject to any disclaimer, the term of this patent is extended or adjusted under 35 U.S.C. 154(b) by 113 days.

(21) Appl. No.: 10/635,455

(22) Filed: Aug. 7, 2003

(65) Prior Publication Data

US 2004/0027357 A1 Feb. 12, 2004

Related U.S. Application Data

(63) Continuation of application No. 09/575,457, filed on May 22, 2000, now abandoned.

(51) Int. Cl.
*G06F 13/14* (2006.01)
*G06T 1/60* (2006.01)

(52) U.S. Cl. ..... 345/519; 345/520; 345/530

(58) Field of Classification Search ..... 345/519, 345/520, 530, 546, 545, 536
See application file for complete search history.

(56) References Cited

U.S. PATENT DOCUMENTS

| | | | | |
|---|---|---|---|---|
| 4,760,387 | A | 7/1988 | Ishii et al. | |
| 5,465,105 | A | 11/1995 | Shatas et al. | |
| 5,606,348 | A | 2/1997 | Chiu | |
| 5,894,594 | A * | 4/1999 | Kang | 455/412.1 |
| 5,917,552 | A | 6/1999 | Van Court | |
| 6,028,646 | A | 2/2000 | Jeong et al. | |
| 6,061,633 | A * | 5/2000 | Fukuhara et al. | 702/6 |
| 6,169,539 | B1 * | 1/2001 | Lee et al. | 345/204 |
| 6,223,283 | B1 * | 4/2001 | Chaiken et al. | 713/1 |
| 6,263,440 | B1 | 7/2001 | Pruett et al. | |
| 6,314,479 | B1 * | 11/2001 | Frederick et al. | 710/63 |
| 6,323,828 | B1 | 11/2001 | Perez | |
| 6,329,981 | B1 | 12/2001 | Lin et al. | |
| 6,333,750 | B1 | 12/2001 | Odryna et al. | |
| 6,373,476 | B1 | 4/2002 | Dalgleish et al. | |
| 6,538,675 | B1 | 3/2003 | Aratani et al. | |
| 6,816,129 | B1 * | 11/2004 | Zimmerman | 345/1.1 |
| 2002/0097234 | A1 | 7/2002 | Sauber | |
| 2004/0150650 | A1 | 8/2004 | Mendelson et al. | |

OTHER PUBLICATIONS

Video Electronics Standards Association, Display Data Channel Standard (version 3.6p, Sep. 1997) (entire document).
Video Electronics Standards Association, Enhanced Display Data Channel Standard (version 1, Sep. 2, 1999) (entire document).
Digital Display Working Group, Digital Visual Interface DVI (revision 1.0, Apr. 2, 1999) (entire document).
Video Electronics Standards Association, VESA Enhanced Extended Display Indentification Data Standard (Release A, Revision 1, Feb. 9, 2000) (entire document).

* cited by examiner

*Primary Examiner*—Kee M. Tung
*Assistant Examiner*—Joni Hsu
(74) *Attorney, Agent, or Firm*—Sterne, Kessler, Goldstein & Fox P.L.L.C.

(57) ABSTRACT

A display is capable of displaying images in response to differently formatted signals. The display includes a switch that enables a user to select among a plurality of signal formats. The switch has a first setting that corresponds to a first of the plurality of signal formats and a second setting that corresponds to a second of the plurality of signal formats. The display also includes a memory module that receives requests from a channel and transmits a response associated with the setting of said switch.

16 Claims, 10 Drawing Sheets

MULTI-MODE DISPLAY

CROSS-REFERENCE TO RELATED APPLICATIONS

This application is a continuation of U.S. patent application Ser. No. 09/575,457, entitled "MULTI-MODE DISPLAY," filed May 22, 2000, now abandoned.

BACKGROUND OF THE INVENTION

1. Field of the Invention

The present invention relates generally to the operation of graphical displays, and more particularly to the interface between a graphical display and a processor.

2. Related Art

Processing systems typically include a processor connected to a display through a display interface. Often, such processors contain graphics subsystems that directly handle the transfer of information, such as image data and control signals, between the processor and the connected display via the display interface. Multi-mode displays are capable of receiving image data signals in different formats, and displaying images in response to these differently-formatted signals. Image data signals are often categorized as being either digital or analog. There are many different industry standards that define various digital and analog image data signal formats.

Certain industry standards provide mechanisms that allow a display to transmit information across a display interface to an attached processor. This information indicates an image data signal format that the display supports. Once this information is received, the attached processor is able to determine the appropriate signal format in which to send image data to the connected display.

Unfortunately, these existing standards do not enable a multi-mode display to indicate its entire set of supported image data signal formats. That is, these standards only allow a multi-mode display to indicate to the processor one image data signal format at a given time.

Accordingly, a disadvantage of these existing standards involves situations where a particular processor supports some, but not all of the image data signal formats that a multi-mode display can support. For example, if a display indicates to a processor a signal format that the processor does not support, the processor will be unable to send image data signals to the display, even though the processor may support other signal formats that are within the attached display's capabilities.

It is generally recognized that displays must comply with industry-endorsed standards to achieve market acceptance. If a display does not comply with such standards, then it will not necessarily inter-operate with processors and graphics subsystems that are prevalent in the marketplace. Accordingly, there is a need for multi-mode displays that comply with industry standards and indicate to attached processors a mutually supportable display data signal format without excessive user interaction and undue delay.

SUMMARY OF THE INVENTION

The present invention provides a display capable of displaying images in response to differently formatted signals. The display includes a switch that enables a user to select among a plurality of signal formats. In one embodiment, the switch has a first setting and a second setting. The first setting corresponds to a first signal format. The second setting corresponds to a second signal format. The display also includes a memory module that receives requests from a communication channel and transmits a response associated with the setting of the switch.

The present invention also provides a display adapter that is capable of receiving differently formatted signals and converting the differently formatted signals for display on a coupled display device. The display adapter includes a switch that enables a user to select among a plurality of signal formats. The switch has a first setting that corresponds to a first of the plurality of signal formats and a second setting that corresponds to a second of the plurality of signal formats. The display adapter also includes a memory module that receives requests from a channel and transmits a response associated with the setting of the switch.

An advantage of the present invention is that it complies with existing industry standards while indicating to attached processors a mutually supportable display data signal format without excessive user interaction and undue delay.

Further advantages of the present invention include the ability to use off-the-shelf components having low power consumption requirements, and the ability to operate even when the display or display adapter is not powered on.

BRIEF DESCRIPTION OF THE FIGURES

The accompanying drawings, which are incorporated herein and form part of the specification, illustrate the present invention and, together with the description, further serve to explain the principles of the invention and to enable a person skilled in the pertinent art to make and use the invention.

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1A:
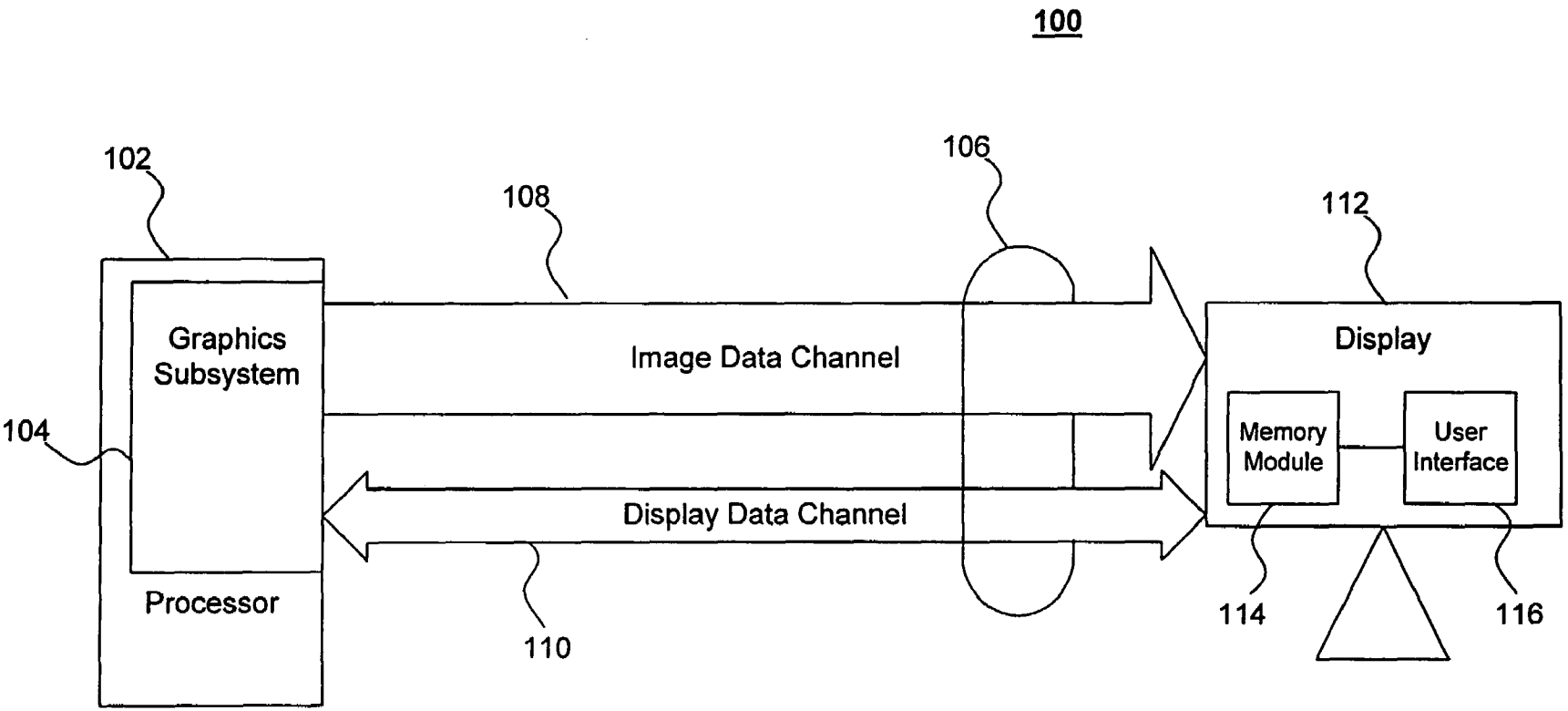
FIGS. 1A and 1B illustrate first and second computer systems according to the present invention.

FIG. 1A illustrates an exemplary computer system 100 according to an embodiment of the present invention. Computer system 100 comprises a processor 102, a display interface 106, and a display 112. Processor 102 and display 112 are connected by display interface 106.

According to the present invention, processor 102 is a computing platform, such as a personal computer or a workstation. However, processor 102 can also be hardware, firmware, or any processing system capable of interacting with a graphical display, as would be apparent to a person skilled in the relevant art(s). In one embodiment, processor 102 includes a graphics subsystem 104. Graphics subsystem 104 receives commands from processing units (not shown)

within processor 102. Based on these commands, graphics subsystem 104 sends image data signals to display 112. Display 112 receives these image data signals and converts them into images that are displayed to a user. Graphics subsystem 104 also engages in bi-directional communication with display 112 across display interface 106.

Display 112 is a graphical display, such as a flat panel display or a cathode ray tube (CRT) display, that is capable of receiving image data signals. Once received, display 112 converts these signals into text and/or one or more graphical images that are displayed to a user. Display 112 is capable of receiving image data signals from display interface 106 in a plurality of different formats. Accordingly, display 112 is referred to herein as a multi-mode display. Multi-mode display 112 comprises a memory module 114 and a user interface 116.

User interface 116 enables a user to select an image data signal format from the plurality of image data signal formats that multi-mode display 112 can support. In one embodiment, user interface 116 is a mechanical switch. However, in further embodiments, user interface 116 can be any type of user interface that enables a user to select one of a plurality of image data signal formats. Examples of such user interfaces include touch screens, graphical user interfaces (GUIs), and other user interfaces that would be apparent to a person skilled in the relevant art(s) from the teachings herein.

Memory module 114 is coupled to user interface 116. Memory module 114 receives signals from display data channel 110 and transmits signals across display data channel 110 to graphics subsystem 104. In particular, memory module 114 transmits stored responses to requests that are originated by graphics subsystem 104. These responses are used by display 112 to indicate an image data signal format that is selected by a user through user interface 116.

According to the present invention, display interface 106 comprises an image data channel 108 and a display data channel 110. Image data channel 108 enables graphics subsystem 104 to send image data signals to display 112. These signals can conform to different analog and/or digital standards. An example of an analog display data standard is RGB component video (popularly referred to as "VGA graphics"). Examples of digital display data standards include DVI, DFP, P&D, OpenLDI, and/or other well known digital display data formats that are apparent to persons skilled in the relevant art(s).

Display data channel 110 enables graphics subsystem 104 and memory module 114 to engage in bi-directional data communications. In one example, display data channel 110 enables graphics subsystem 104 and memory module 114 to exchange information according to a request and response protocol. According to this protocol, graphics subsystem 104 sends requests for display data to display 112. In response, memory module 114 replies with the requested display data. This display data indicates an image data signal format that a user selected through interaction with user interface 116. For example, display data transmitted by display 112 can indicate whether display 112, according to a user selection, supports the reception of digital image data signals in a certain format, or analog image signals in a certain format. In an embodiment, the display data transmitted by display 112 can indicate whether display 112, according to a user selection, supports the reception of digital signals in a first format, or digital signals in a second format.

In addition, display data transmitted by memory module 114 can also indicate operational parameters of display 112, such as refresh rate and resolution. In one embodiment, the request and response protocol described above conforms to a standard known as Display Data Channel (DDC). This standard was developed by the Video Electronics Standards Association (VESA) of Milpitas Calif., and is described in the VESA document *Display Data Channel Standard*, v3.6p, September 1997 (incorporated herein by reference in its entirety). In a further embodiment, this request and response protocol conforms to a standard developed by VESA known as Enhanced Display Data Channel (E-DDC). E-DDC is described in the VESA document *Enhanced Display Data Channel Standard,* Version 1, Sep. 2, 1999 (incorporated herein by reference in its entirety).

As described above, display interface 106 establishes a connection between processor 102 and display 112. In an embodiment of the present invention, display interface 106 comprises one or more cables that connect to processor 102 and display 112 via connectors. Examples of such connectors include DVI-D connectors, DVI-I connectors, DFP connectors, and VGA (HD15) connectors. These connectors are well known to persons skilled in the relevant art(s). Also, these connectors provide electrical interfaces for cables comprising multiple electrical conductors. In further embodiments, display interface 106 can be implemented with a data network. Examples of data networks include local area networks (LANs), such as high data rate Ethernets, wide area networks (WANs), wireless data networks, optical communications links, and other communications means, as would be apparent to a person skilled in the relevant art(s).

In one embodiment, display interface 106 complies with the Digital Visual Interface (DVI) standard. DVI is a standard developed by the Digital Display Working Group (DDWG), and is described in the document *Digital Visual Interface* (DVI), revision 1.0, Apr. 2, 1999 (incorporated herein by reference in its entirety). The DVI standard is implemented with a cable comprising multiple conductors. Each of these conductors is dedicated to a distinct electrical signal. These electrical signals, as specified by the DVI standard, include digital and analog image data signals, as well as digital and analog control signals.

DVI digital image data signals convey image data to displays according to an electrical signaling format known as transition minimized differential signaling (TMDS). The analog image data signals comply with a red, green, blue (RGB) transmission format, as would be apparent to a person skilled in the relevant art(s).

Image data channel 108 includes electrical conductors that transfer these image data signals from graphics subsystem 104 to display 112. Display data channel 110 includes electrical conductors that communicate data between graphics subsystem 104 and display 112 that indicates the capabilities of display 112.

In the embodiment where display interface 106 complies with the DVI standard, display data channel 110 communications are conducted over a two-wire serial bus known as an Inter-Integrated Circuit ($I^2C$) interface, as developed by Philips Semiconductor. In further embodiments, a variety of other standard serial interfaces can carry display data channel 110 communications, as would be apparent to a person skilled in the relevant art(s). $I^2C$ interfaces enable two-way communication of baseband digital data between devices known as master devices and slave devices. $I^2C$ interfaces, as described above, comprise two conductors. These two conductors, or lines, are a serial data line (SDA) and a serial clock line (SCL). According to the present invention, processor 102 is an $I^2C$ master device, while memory module 114 is an $I^2C$ slave device. According to the DVI standard, communications across the $I^2C$ display data channel 110 are conducted according to either the DDC or the E-DDC standards described above.

Figure 1B:
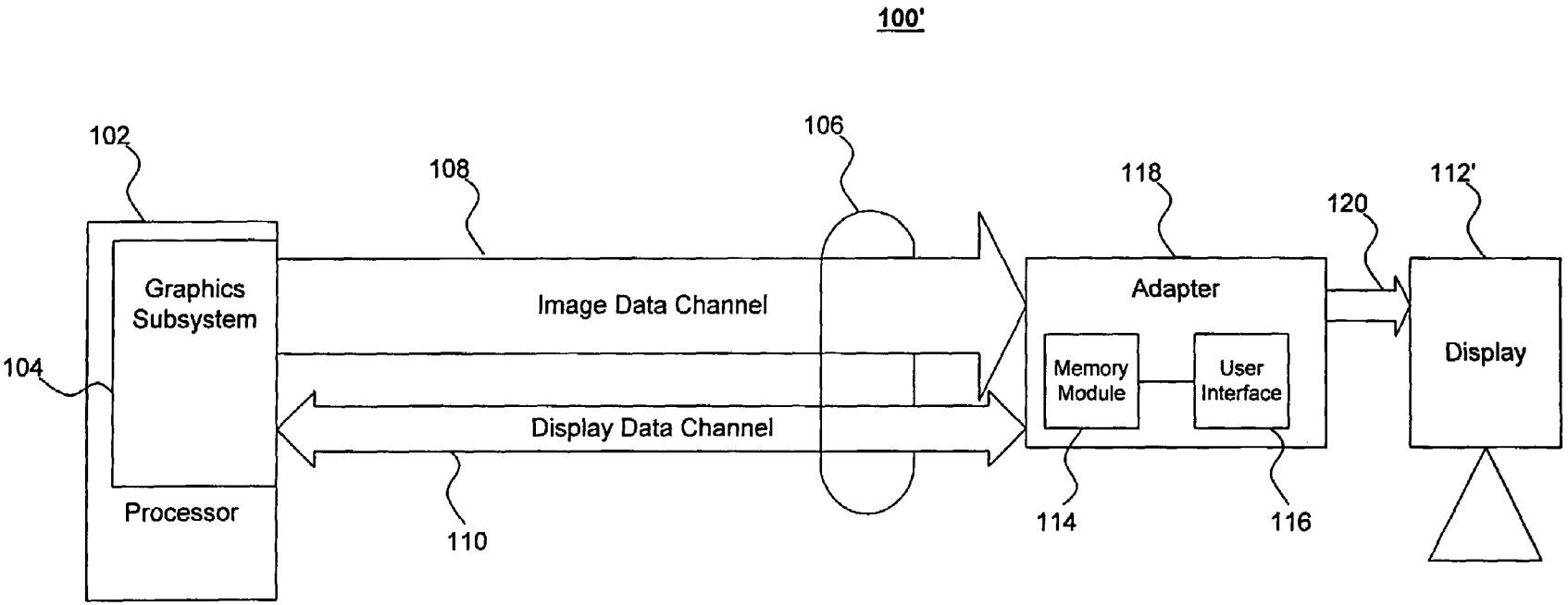

FIG. 1B illustrates a second computer system 100' according to the present invention. Like first computer system 100, second computer system 100' is capable of supporting multiple image data signal formats. However, instead of comprising a multi-mode display 112, second computer system 100' includes a single-mode display 112'. An adapter 118 provides an interface between display interface 106 and single-mode display 112'.

Like display 112, adapter 118 comprises memory module 114 and user interface 116. Thus, adapter 118 is capable of receiving image data signals in multiple formats and engaging in bi-directional data communication with processor 102 over display data channel 110. When adapter 118 receives image data signals from graphics subsystem 104, it converts these signals, when necessary, into a format that is supported by display 112'. Adapter 118 then transfers the converted image data signals across an interface 120 to display 112'. Display 112' converts these signals into displayed text and/or images for a user.

Figure 2:
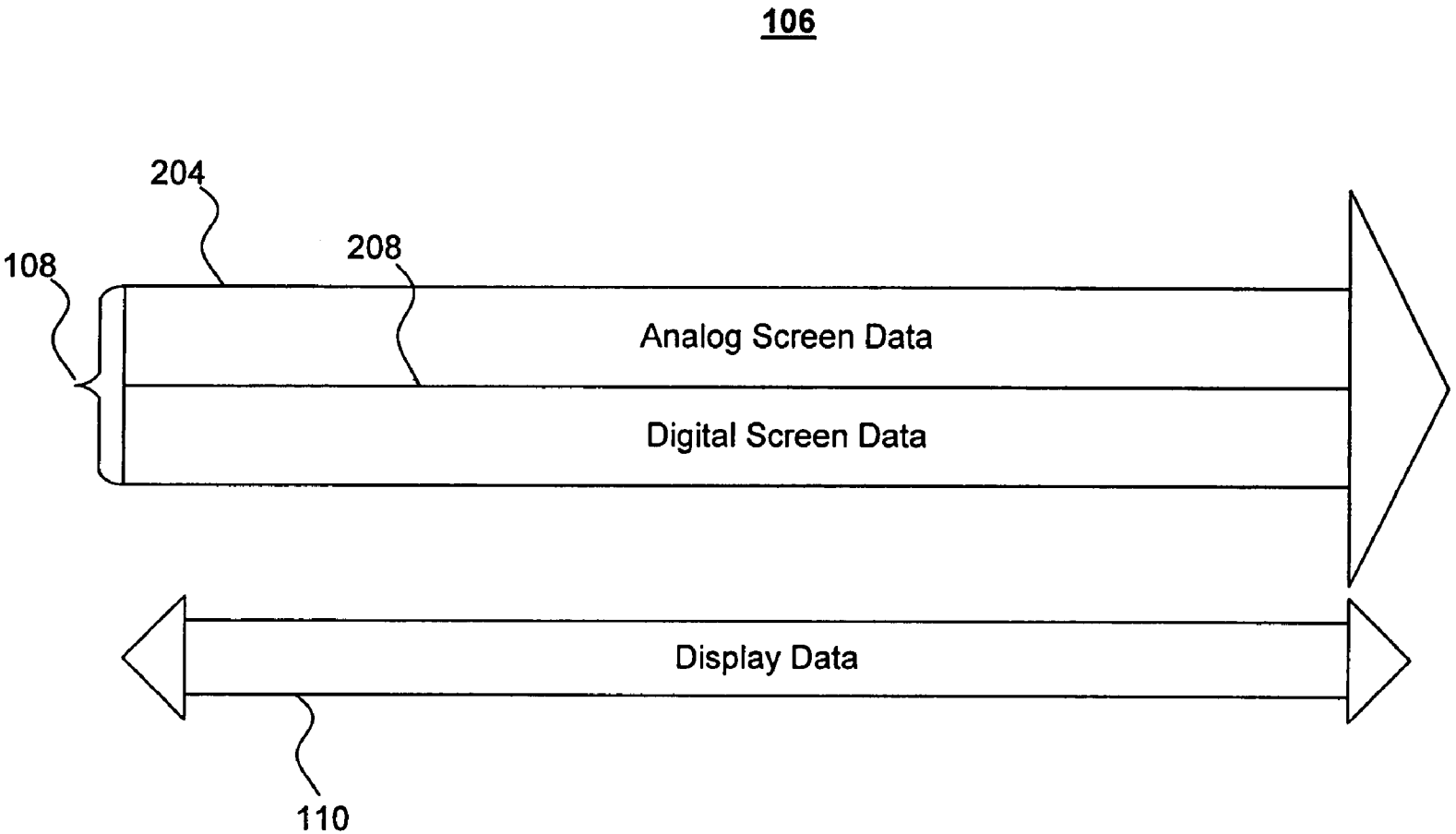
FIG. 2 illustrates a display interface according to the present invention.

FIG. 2 illustrates display interface 106 in greater detail. As described above, display interface 106 comprises a display data channel 110 and an image data channel 108. In one embodiment, image data channel 108 comprises an analog screen data channel 204 and a digital screen data channel 208. Analog screen data channel 204 conveys analog image signals and digital screen data channel 208 conveys digital image data signals. As described above, analog image data signals include RGB signals, as well as other analog signal formats that are apparent to persons skilled in the relevant art(s). Digital image data signals include signals in a variety of formats that are well known to persons skilled in the relevant art(s). In further embodiments, display interface 106 can include multiple analog and digital screen data channels 204 and 208, in any combination. Also, display interface 106 can include only an analog screen data channel 204 or a digital screen data channel 208.

As described above, display 112 and adapter 118 both comprise a user interface 116 and a memory module 114. In an embodiment of the present invention, user interface 116 is a switch that enables a user to select among a plurality of signal formats. Switch 116 has a plurality of settings. Each of these settings corresponds to one of the plurality of image data signal formats that are supported by either display 112 or adapter 118. Memory module 114 is coupled to user interface 116 and display interface 106. In particular, memory module 114 is coupled to display data channel 110 of display interface 106.

Memory module 114 receives processor 102 originated requests from display data channel 110. Memory module 114 also transmits responses across display data channel 110. These responses are associated with the setting of switch 116. These responses are data structures that indicate the image data signal format selected by the user through user interface 116.

Figure 3:
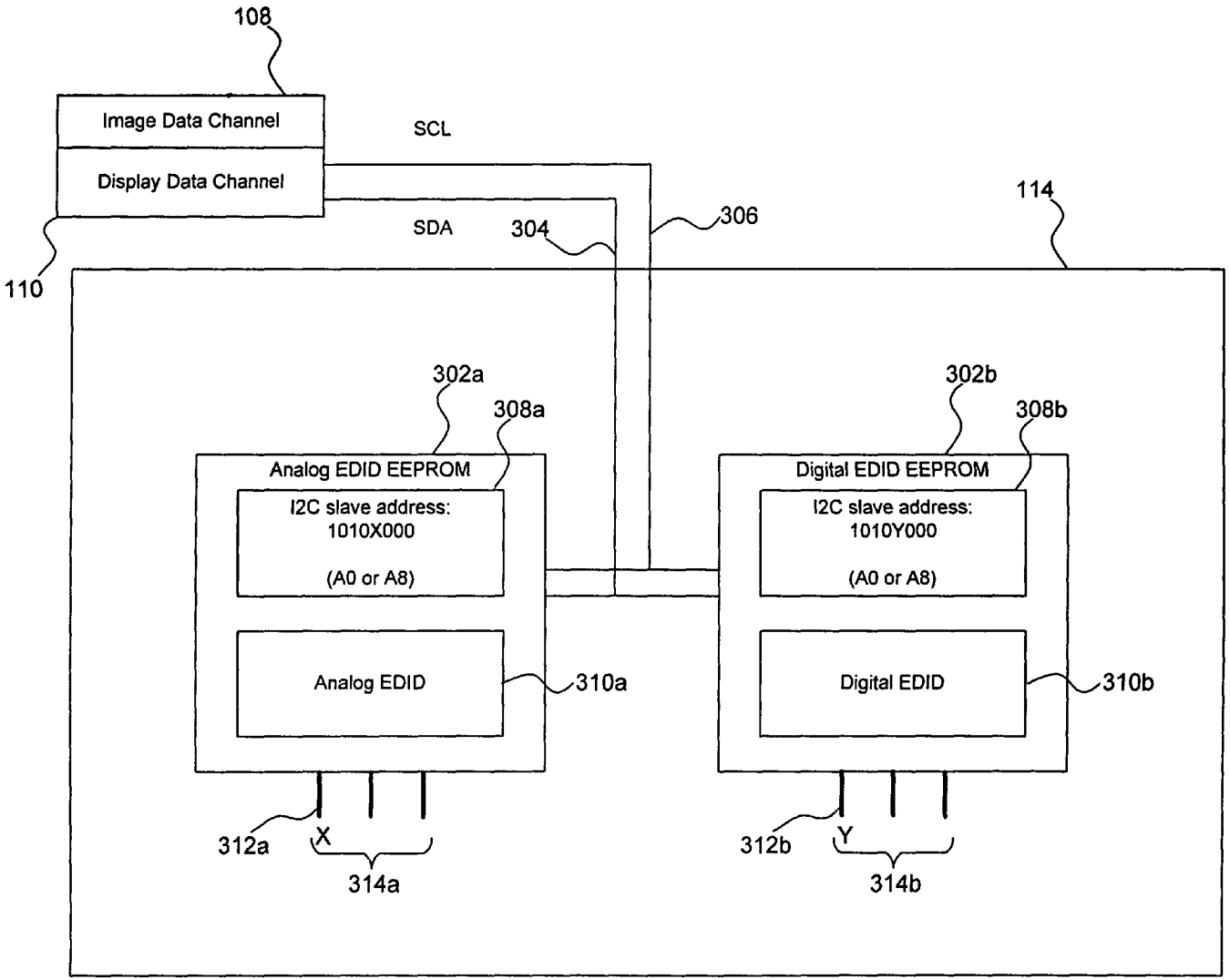
FIGS. 3, 4, and 5 illustrate an embodiment of a memory module according to the present invention.

FIG. 3 illustrates an implementation of memory module 114. In this implementation, memory module 114 comprises a first memory 302*a* and a second memory 302*b*. Memories 302*a* and 302*b* correspond to user-selectable analog and digital display data signal formats, respectively. Extensions of this implementation can provide for as many memories 302 as there are user-selectable display data signal formats. In an embodiment of the present invention, memories 302 are serial Electrical Erasable Programmable Read Only Memories (EEPROMs). However, other types of memory can be used, as would be apparent to a person skilled in the relevant art(s).

Many serial EEPROMs are commercially available off-the-shelf components. In addition serial EEPROMs exist that require only a small amount of electrical current to function. Thus, the present invention can operate with minimal power consumption. In addition, according to embodiments of the present invention, display interface 106 carries an electrical power signal generated by graphics subsystem 104. This power signal enables memory module 114 to respond with data even when display 112 or display adapter 118 is not powered. A description of such power signals can be found in the document *Digital Visual Interface* (DVI), revision 1.0, Apr. 2, 1999 (incorporated herein by reference in its entirety).

In the embodiment shown in FIG. 3, display data channel 110 is an $I^2C$ serial interface. Memories 302*a* and 302*b* are both connected to a serial data (SDA) line 304 and a serial clock (SCL) line 306 of $I^2C$ display data channel 110. Each memory 302*a* and 302*b* is an $I^2C$ slave device having an $I^2C$ slave address. Each memory 302*a* and 302*b* also has a respective address interface 314*a*, 314*b*.

Address interfaces 314*a* and 314*b* each comprise one or more address lines (or terminals) 312 that accept input logic signals. The values of these input logic signals determine the $I^2C$ slave address 308*a* and 308*b* of each memory 302*a* and 302*b*, respectively. As illustrated in FIG. 3, the address of each memory 302*a* and 302*b* is represented by eight bits. However, other length addresses can be implemented according to the present invention. Also, in FIG. 3, address interfaces 314*a* and 314*b* each comprise three address lines that accept input logic signals. For each corresponding memory 302, these three address lines correspond to bit positions three through one of the associated eight bit address 308. However, address interfaces 314*a* and 314*b* can comprise any number of such address lines that represent any combination of bit positions.

Requests that are transmitted by processor 102 across $I^2C$ display data channel 110 include an $I^2C$ slave address 308. According to the DVI standard, a designated address is used for all such requests. At memory module 114, each memory 302*a* and 302*b* receives such requests. However, in accordance with $I^2C$ communications rules, only the particular memory 302*a* or 302*b* having this designated address will respond to such requests. This response is a data structure 310*a* or 310*b*.

Each memory 302*a*, 302*b* contains a respective data structure 310*a*, 310*b* that describes the corresponding display data signal format. As described above, memory module 114 transmits responses to requests received from processor 102 via display data channel 110. In the implementation shown in FIG. 3, these responses comprise the data structure 310 that is associated with a display data signal format selected by a user through user interface 116.

According to the DVI standard, each data structure 302*a*, 302*b* is an Extended Display Identification Data (EDID) structure. However, each data structure 302*a*, 302*b* can also be an Enhanced Extended Display Identification Data (EEDID) structure. EDIDs and EEDIDs are industry standard data structures developed by VESA. These data structures allow a display to communicate its capabilities to processor 102, and are well known to persons skilled in the relevant art(s). Descriptions of these data structures are provided in *VESA Enhanced EDID Standard,* Release A, Rev. 1, Feb. 9, 2000 (incorporated herein by reference in its entirety). In further embodiments, data structures 310*a* and 310*b* can be formatted according to other industry standards, or can be in any format that is apparent to persons skilled in the relevant art(s) from the teachings herein.

As described above, memory module 114 is connected to user interface 116. User interface 116 enables a user to select among a plurality of image data signal formats. User interface 116 has a plurality of settings. Each of these settings corresponds to one of the plurality of image data signal formats. In one embodiment, user interface 116 is a mechanical switch. However, in further embodiments, user interface 116 can be any type of user interface that enables a user to select one of a plurality of image data signal formats. For the particular memory module 114 implementation shown in FIG. 3, the connected user interface 116 has a first setting corresponding to an analog image data signal format, and a second setting corresponding to a digital image data signal format.

As described above, requests transmitted by processor 102 across display data channel 110 contain a designated $I^2C$ address. The setting of user interface 116 determines which memory 302 has this designated address, and accordingly, which memory 302 transmits its data structure 310 in response to these requests. User interface 116 performs this address determination by changing the values of input logic signals on address lines 312.

As described herein, implementations of memory module 114 can provide for as many memories 302 as there are user-selectable display data signal formats. For instance, a similarly implemented memory module 114 can include a third memory 302*c* connected to SDA line 304 and SCL line 306 that has an $I^2C$ slave address 308*c, a* data structure 310*c*, and an address interface 314*c* that comprises one or more address lines (or terminals) 312.

Figure 4:
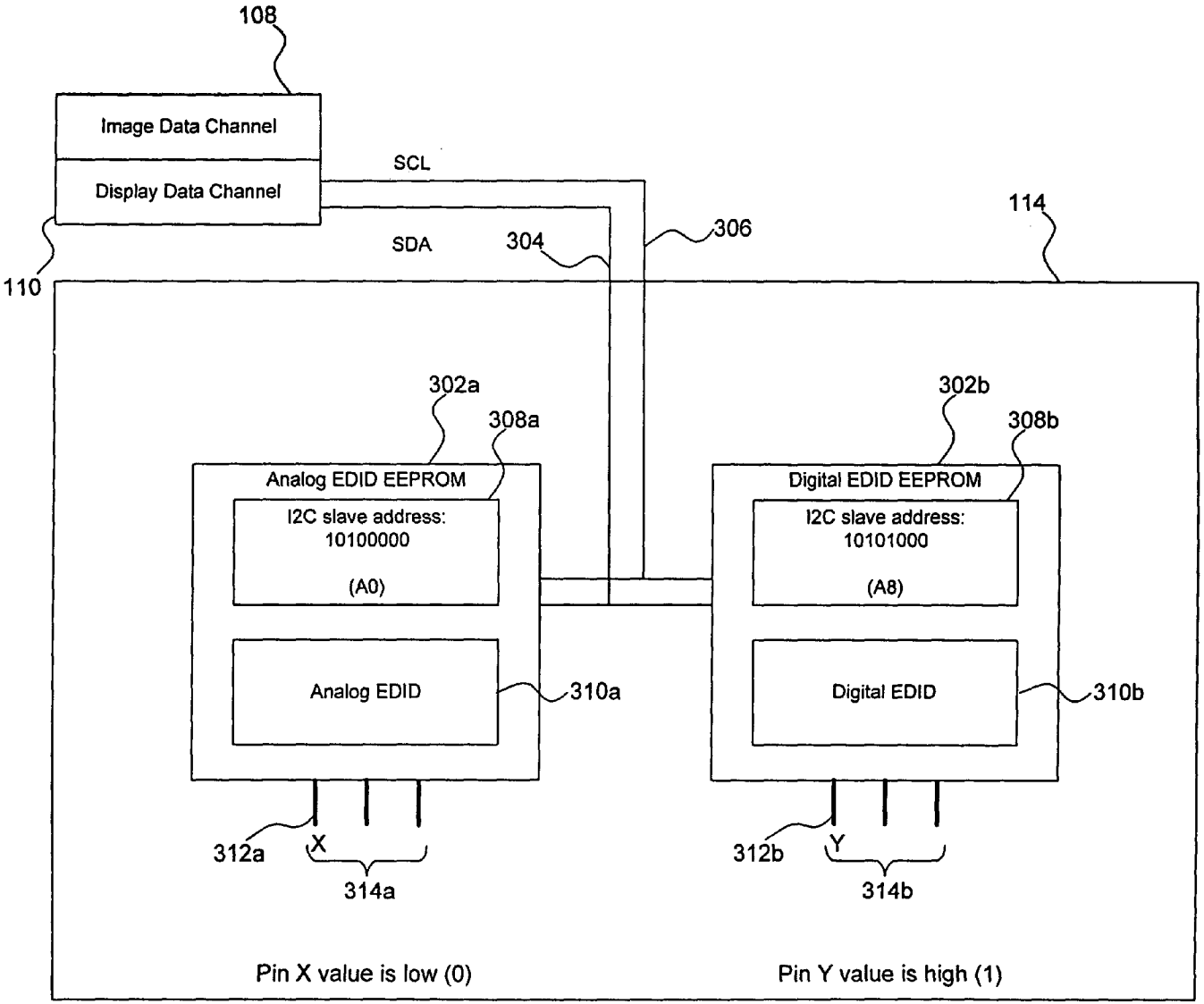
Figure 5:
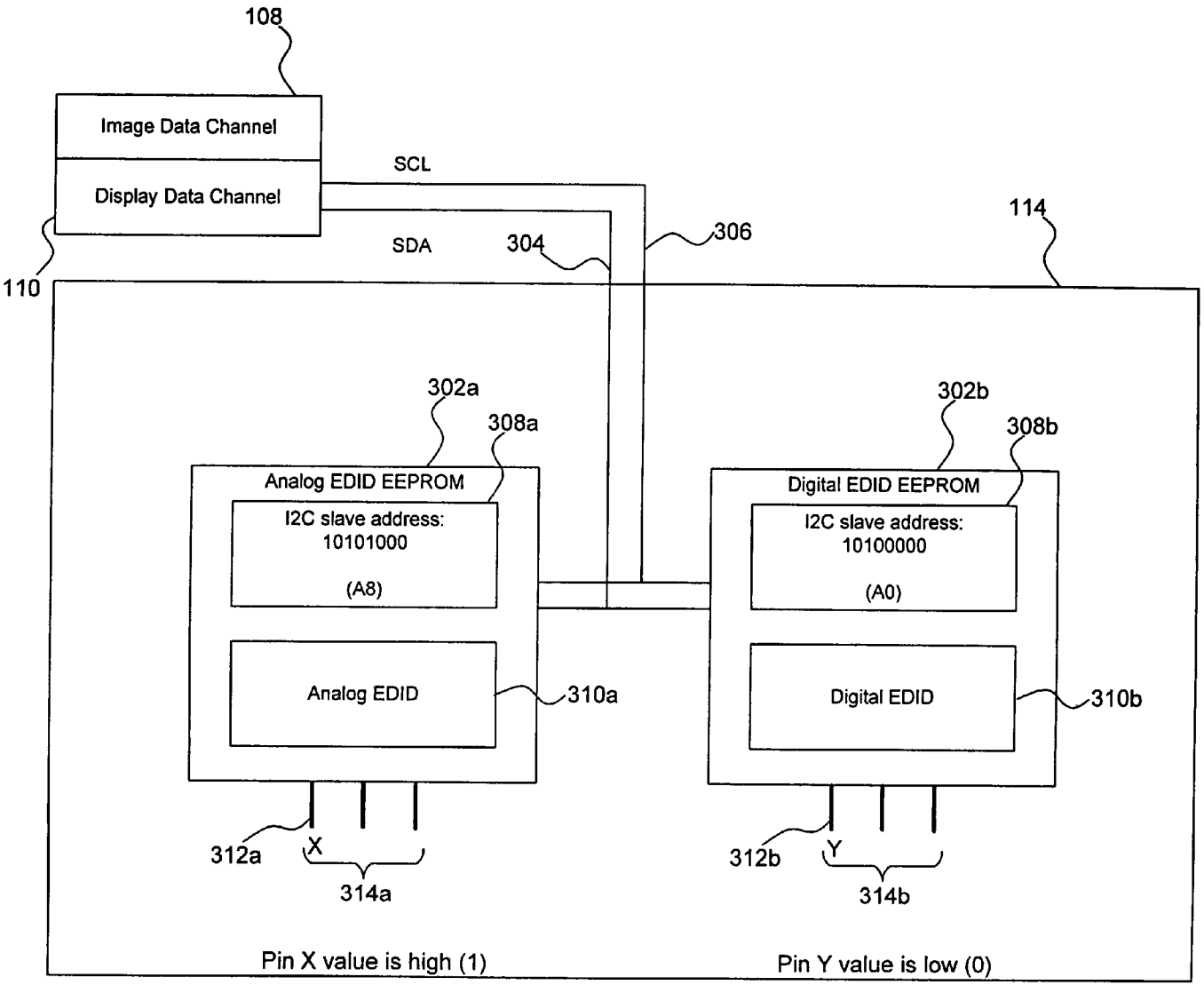

FIGS. 4 and 5 illustrate, for the embodiment shown in FIG. 3, how the values of input logic signals on address lines 312*a* and 312*b* determine the slave addresses 308*a* and 308*b*. As described above, each address line 312*a*, 312*b* receives an input logic signal. Each of these signals are binary logic signals that represent a single bit of an $I^2C$ slave address comprising multiple bits. According to the DVI standard, a designated address, expressed in binary, is 10100000 (A0 hexadecimal). Accordingly, a memory 302 will have the designated address A0 when a user selects the corresponding image data signal format. Memories 302 that do not correspond to the selected image data signal format will have an alternate address. In the implementation shown in FIGS. 3, 4, and 5, this alternate address, expressed in binary, is 10101000 (A8 hexadecimal).

There is only a one bit difference between the values of A0 and A8. Therefore, to provide a memory 302 with the designated address of A0, user interface 116 only has to toggle the binary value of a single address line 312 for each memory 302. With reference to FIGS. 3, 4, and 5, these lines are address line 312*a* for memory 302*a* and address line 312*b* for memory 302*b*. For address lines 312*a* and 312*b*, the corresponding binary input logic signals are indicated with the variables X and Y, respectively. The values of these variables determines which memory 302 has the designated address.

As illustrated in FIG. 4, when X is a logical "0" and Y is a logical "1", memory 302*a* has the designated address A0, while memory 302*b* has the alternate address A8. Consequently, memory 302*a* will respond to requests with response 310*a*. In contrast, FIG. 5 illustrates the case where X is a logical "1" and Y is a logical "0". In this case, memory 302*b* has the designated address A0, while memory 302*a* has the alternate address A8. Therefore, memory 302*a* will respond to requests with response 310*b*. As described above, responses 310*a* and 310*b* are data structures, such as EDIDs or EEDIDs, that describe analog and digital image data signal formats, respectively.

Figure 6A:
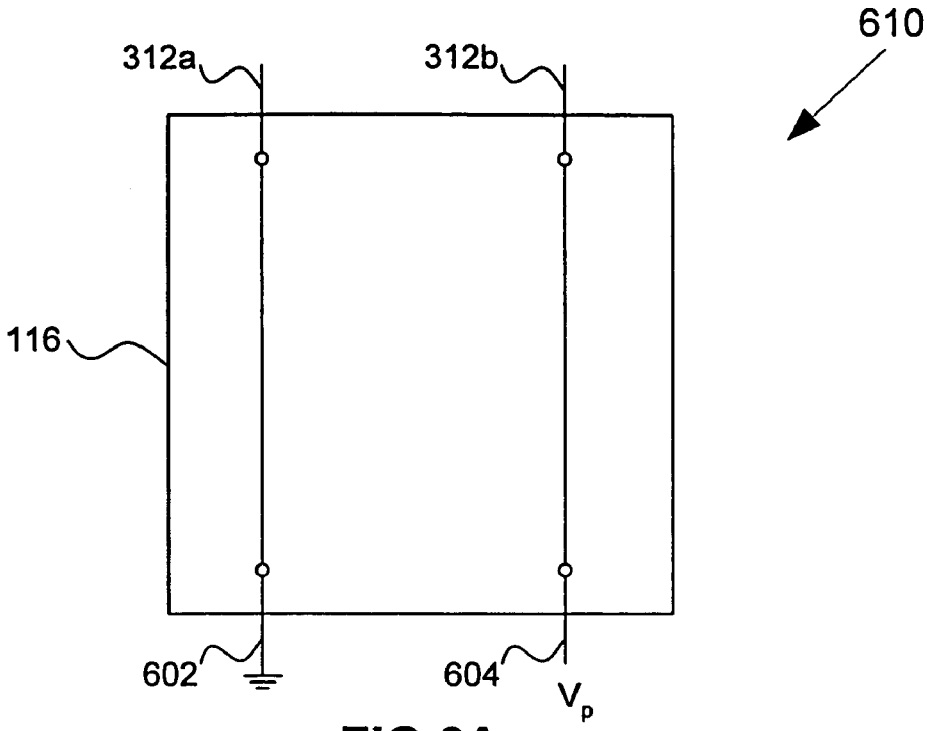
FIGS. 6A and 6B illustrate two configurations of a switch according to the present invention.
Figure 6B:
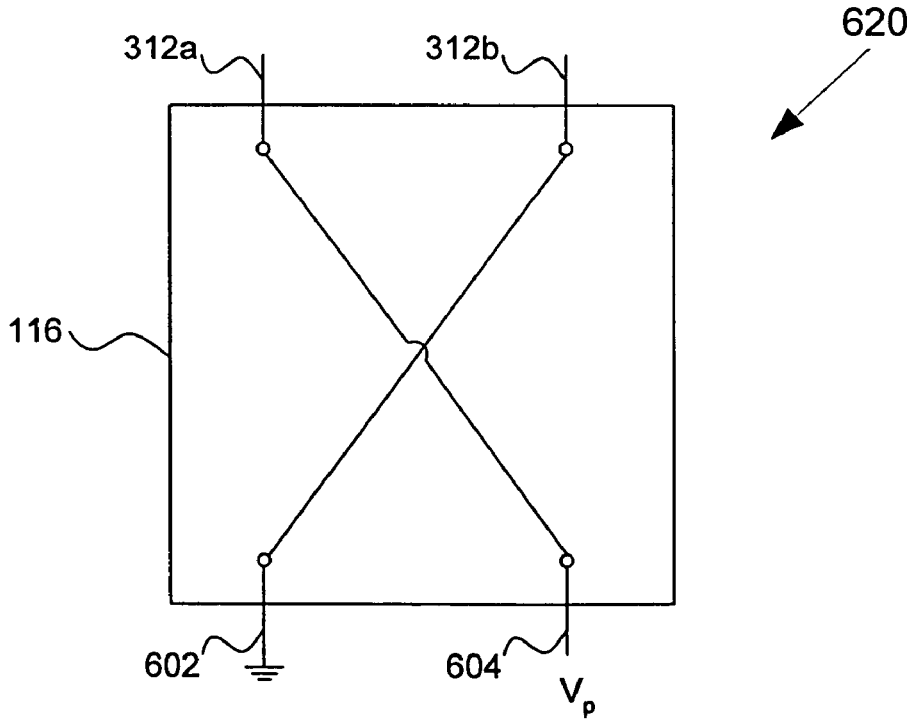

FIGS. 6A and 6B illustrate a first setting 610 and a second setting 620 of switch 116 according to the present invention. Switch 116 comprises first and second voltage input signals 602 and 604. Input signal 602 is a ground signal, while input signal 604 has a voltage Vp. In FIGS. 6A and 6B, Vp designates a logical "1", while ground represents a logical "0". However, other signal conventions can be implemented, as would be apparent to a person skilled in the relevant art(s). In particular, other signal conventions can allow for a switch 116 with three or more different settings.

Setting 610 corresponds to the selection of memory 302*a*, as described above with reference to FIG. 4. Input signal 602 is connected to address line 312*a*, and input signal 604 is connected to address line 312*b*. Since input signal 602 represents a logical "0", the variable X is also "0". Therefore, address 308*a* is the designated address A0. In contrast, input signal 604 represents a logical "1". Therefore, the variable Y is also "1" and address 308*b* is the alternate address A8.

Setting 620 corresponds to the selection of memory 302*b*, as described above with reference to FIG. 5. Input signal 602 is connected to address line 312*b*, and input signal 604 is connected to address line 312*a*. Since input signal 602 represents a logical "0", the variable Y is also "0". Therefore, address 308*b* is the designated address A0. In contrast, input signal 604 represents a logical "1". Therefore, the variable X is also "1" and address 308*a* is the alternate address A8.

Figure 7A:
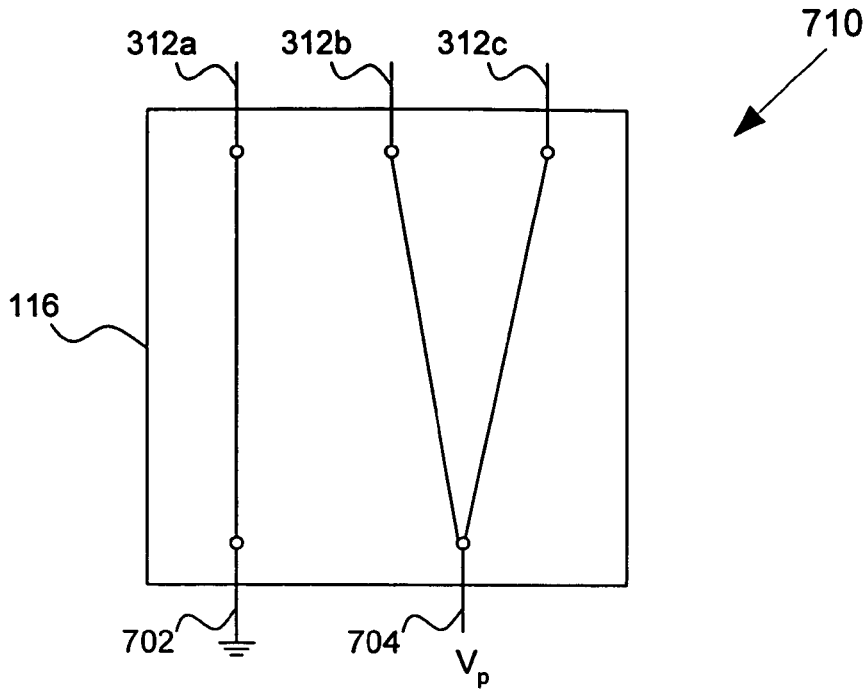
FIGS. 7A, 7B, and 7C illustrate three configurations of a switch according to the present invention.
Figure 7B:
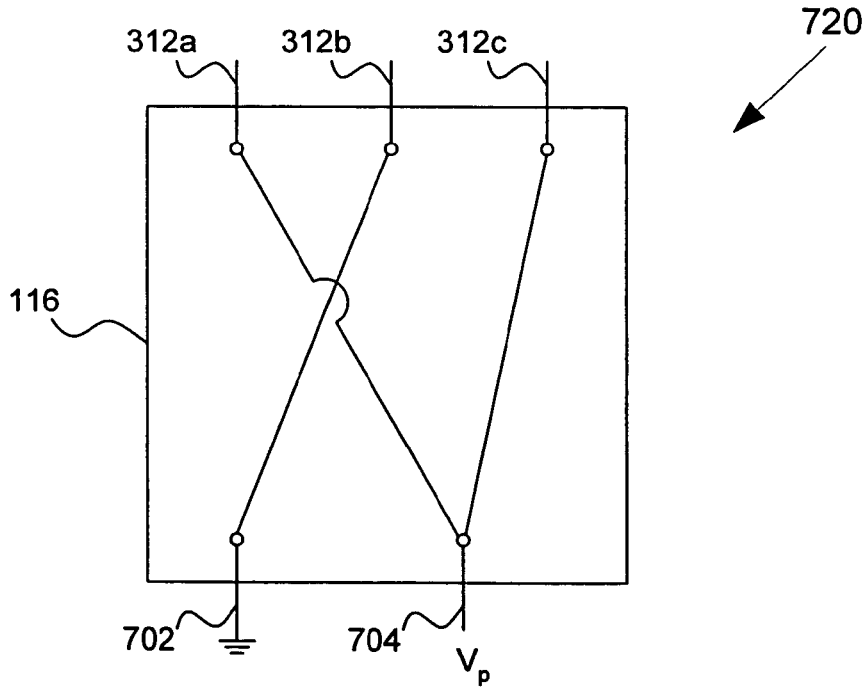
Figure 7C:
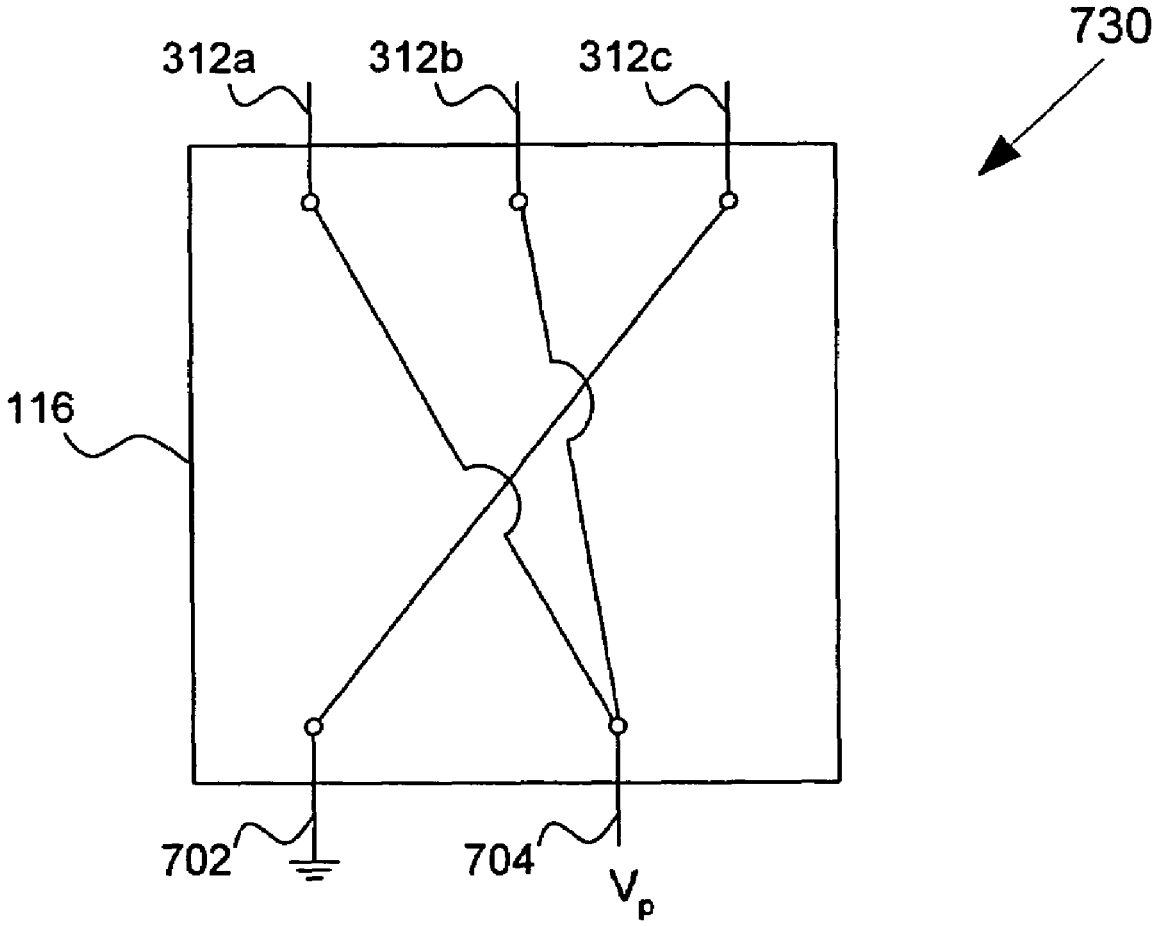

FIGS. 7A, 7B, and 7C illustrate a first setting 710, a second setting 720, and a third setting 730 of an implementation of switch 116 according to the present invention. The implementation of switch 116 illustrated in FIGS. 7A–7C is directed to the embodiment described herein, where memory module 114 includes three memories (302*a*, 302*b*, and 302*c*). Like memories 302*a* and 302*b*, memory 302*c* includes an address interface 314*c* comprising an address line 312*c*. A binary input logic signal Z corresponds to address line 312*c*. The value of Z determines whether the address 308*c* of memory 302*c* is the designated address. In particular, when Z is a logical "0", memory 302*c* has the designated address A0. However, when Z is a logical "1", memory 302*c* has the alternate address A8.

Switch 116 comprises first and second voltage input signals 702 and 704. Input signal 702 is a ground signal, while input signal 704 has a voltage Vp. In FIGS. 7A–7C, Vp designates a logical "1", while ground represents a logical "0". However, other signal conventions can be implemented, as would be apparent to a person skilled in the relevant art(s).

Setting 710 corresponds to the selection of memory 302*a*. Input signal 702 is connected to address line 312*a*, and input signal 704 is connected to address lines 312*b* and 312*c*. Since input signal 702 represents a logical "0", the variable X is also "0". Therefore, address 308*a* is the designated address A0. In contrast, input signal 704 represents a logical "1". Therefore, the variables Y and Z are also "1" and addresses 308*b* and 308*c* are the alternate address A8.

Setting 720 corresponds to the selection of memory 302*b*. Input signal 702 is connected to address line 312*b*, and input signal 704 is connected to address lines 312*a* and 312*c*. Since input signal 702 represents a logical "0", the variable Y is also "0". Therefore, address 308*b* is the designated address A0. In contrast, input signal 704 represents a logical "1". Therefore, the variables X and Z are also "1" and addresses 308*a* and 308*c* are the alternate address A8.

Setting 730 corresponds to the selection of memory 302*c*. Input signal 702 is connected to address line 312*c*, and input signal 704 is connected to address lines 312*a* and 312*b*. Since input signal 702 represents a logical "0", the variable Z is also "0". Therefore, address 308*c* is the designated address A0. In contrast, input signal 704 represents a logical "1". Therefore, the variables X and Y are also "1" and addresses 308*a* and 308*b* are the alternate address A8.

Figure 8:
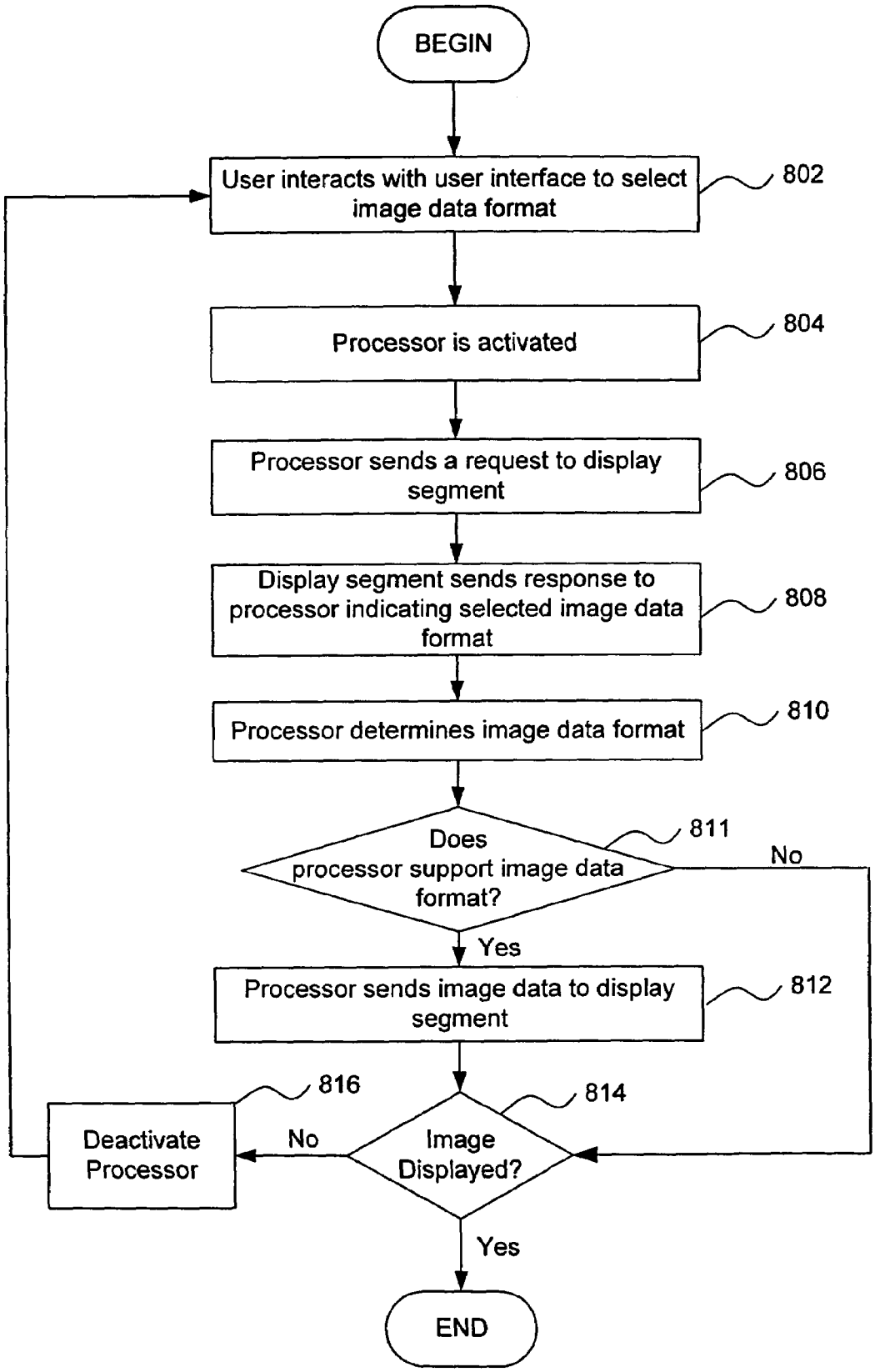
FIG. 8 is a flowchart illustrating an operation of the present invention.

FIG. 8 is a flowchart illustrating an operation of the present invention. This operation begins with a step 802, where a user interacts with user interface 116 to select an image data signal format. In an embodiment of the present invention, this step comprises a user toggling switch 116 to select an image data signal format. Next, a step 804 is performed. In step 804, processor 102 is activated. This activation can comprise the steps of powering on processor 102, and/or commanding graphics subsystem 104 to initialize communications with display 112 or adapter 118. Next in a step 806, processor 102 sends a request to display 112 or adapter 118. This request is transmitted across display data channel 110. In one embodiment, this request is a DDC request. However, in a further embodiment, this request is an E-DDC request.

A step 808 is performed after step 806. In step 808, display 112 or adapter 118 sends a response to processor 102. This response is a data structure that indicates the image data signal format selected by a user. In an embodiment where the request sent in step 806 is a DDC request, this response is an EDID structure. However, in an embodiment where the request sent in step 806 is an E-DDC request, this response is an E-EDID structure.

In a step 810, processor 102 receives the response sent in step 808. Processor 102 then determines the image signal data format described in the response. In an embodiment, this step is performed by graphics subsystem 104. After completion of step 810, a step 811 is performed. In this step, processor 811 determines whether it supports the image data signal format determined in step 810. In an embodiment of the present invention, this step is performed by graphics subsystem 104.

If processor 102 determines in step 811 that it supports the image data signal format determined in step 810, then a step 812 is performed next. Otherwise, a step 814 is performed next. In step 812, processor 102 sends image data to display 112 or adapter 118 via image data channel 108 for display to a user. In one embodiment, this step is performed by graphics subsystem 104.

In step 814, a user determines whether an image is displayed on display 112. If an image is displayed, then the operation is complete. However, if an image is not displayed, then a step 816 is performed. In step 816, processor 102 is deactivated. This deactivation can comprise the steps of powering down processor 102, and/or commanding graphics subsystem 104 to reinitialize communications with display 112 or adapter 118. After performance of step 816, steps 802 through 814 are performed, as described above.

While various embodiments of the present invention have been described above, it should be understood that they have been presented by way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined only in accordance with the following claims and their equivalents.

What is claimed is:

1. A multi-mode display for operating with a processor, comprising:

a switch that enables a user to select among a plurality of different image data signal formats supported by the display, said switch having a first setting corresponding to a first of said plurality of different image data signal formats and a second setting corresponding to a second of said plurality of different image data signal formats; and a memory module that receives requests from a channel and transmits a response associated with the setting of said switch, the response indicating the image data signal format selected by the user, wherein the memory module receives image data signals in the selected image data signal format if the processor supports the selected image data signal format, and wherein the switch enables the user to select another one of said plurality of different image data signal formats if the memory module does not receive image data signals in the selected image data signal format.

2. The display of claim 1, wherein said memory module comprises a first memory and a second memory, each of said first and second memories containing a response associated with one of the first and second switch settings.

3. The display of claim 2, wherein each of said first and second memories is a serial electrical erasable programmable read only memory (EEPROM).

4. The display of claim 1, wherein said channel is an Inter-Integrated Circuit ($I^2C$) serial bus.

5. The display of claim 1, wherein said channel is a display data channel (DDC).

6. The display of claim 1, wherein said response includes an Extended Display Identification Data (EDID) structure corresponding to one of said plurality of different image data signal formats.

7. The display of claim 1, wherein said response includes an Enhanced Extended Display Identification Data (EEDID) structure corresponding to one of said plurality of different image data signal formats.

8. A method for a multi-mode display of establishing operation with a processor, the method comprising the steps of:

receiving a request from the processor;

transmitting to the processor a response associated with a setting of a switch having a plurality of settings corresponding to a plurality of different image data signal formats supported by the display, the response indicating an image data signal format selected by a user with the switch from the plurality of different image data signal formats;

receiving image data signals from the processor in the selected image data signal format if the processor supports the selected image data signal format; and enabling the user to select another one of the plurality of different image data signal formats with the switch if image data signals in the selected image data signal format are not received from the processor.

9. A multi-mode display adapter for operating with a processor, the display adapter capable of converting image data signals for display on a coupled display device, comprising:

a switch that enables a user to select among a plurality of different image data signal formats supported by the display adapter, said switch having a first setting corresponding to a first of said plurality of different image data signal formats and a second setting corresponding a second of said plurality of different image data signal formats; and a memory module that receives requests from a channel and transmits a response associated with the setting of said switch, the response indicating the image data signal format selected by the user, wherein the memory module receives image data signals in the selected image data signal format if the processor supports the selected image data signal format, and wherein the switch enables the user to select another one of said plurality of different image data signal formats if the memory module does not receive image data signals in the selected image data signal format.

10. The display adapter of claim 9, wherein said memory module comprises a first memory and a second memory, each of said first and second memories containing a response associated with one of the first and second switch settings.

11. The display adapter of claim 9, wherein each of said first and second memories is a serial electrical erasable programmable read only memory (EEPROM).

12. The display adapter of claim 9, wherein said channel is an Inter-Integrated Circuit ($I^2C$) serial bus.

13. The display adapter of claim 9, wherein said channel is a display data channel (DDC).

14. The display adapter of claim 9, wherein said response includes an Extended Display Identification Data (EDID) structure corresponding to one of said plurality of different image data signal formats.

15. The display adapter of claim 9, wherein said response includes an Enhanced Extended Display Identification Data (EEDID) structure corresponding to one of said plurality of different image data signal formats.

16. A method for a multi-mode display adapter of establishing operation with a processor, the display adapter capable of converting image data signals for display on a coupled display device, the method comprising the steps of:

receiving a request from the processor; and transmitting to the processor a response associated with a setting of a switch having a plurality of settings corresponding to a plurality of different image data signal formats supported by the display adapter, the response indicating an image data signal format selected by a user with the switch from the plurality of different image data signal formats;

receiving image data signals from the processor in the selected image data signal format if the processor supports the selected image data signal format; and enabling the user to select another one of the plurality of signal formats with the switch if image data signals in the selected image data signal format are not received from the processor.

* * * * *

UNITED STATES PATENT AND TRADEMARK OFFICE

CERTIFICATE OF CORRECTION

PATENT NO. : 7,009,616 B2
APPLICATION NO. : 10/635455
DATED : March 7, 2006
INVENTOR(S) : Mendelson et al.

It is certified that error appears in the above-identified patent and that said Letters Patent is hereby corrected as shown below:

Column 12
At line 13, please delete the word "and".

Signed and Sealed this

Seventeenth Day of June, 2008

JON W. DUDAS
*Director of the United States Patent and Trademark Office*